US007270777B2

(12) United States Patent
Becker

(10) Patent No.: US 7,270,777 B2
(45) Date of Patent: Sep. 18, 2007

(54) METHOD AND APPARATUS FOR PRODUCING A LOW-SHRINKING SMOOTH YARN

(75) Inventor: Stefan Becker, Wipperfürth (DE)

(73) Assignee: Saurer GmbH & Co. KG, Monchengladbach (DE)

( * ) Notice: Subject to any disclaimer, the term of this patent is extended or adjusted under 35 U.S.C. 154(b) by 408 days.

(21) Appl. No.: 10/691,044

(22) Filed: Oct. 22, 2003

(65) Prior Publication Data

US 2004/0080074 A1 Apr. 29, 2004

Related U.S. Application Data

(63) Continuation of application No. PCT/EP02/04870, filed on May 3, 2002.

(30) Foreign Application Priority Data

May 5, 2001 (DE) ..... 101 21 987

(51) Int. Cl.

| | |
|---|---|
| ***D01D 5/088*** | (2006.01) |
| ***D01D 5/16*** | (2006.01) |
| ***D01F 6/62*** | (2006.01) |
| ***D02G 1/12*** | (2006.01) |
| ***D02G 1/16*** | (2006.01) |
| ***D02G 3/00*** | (2006.01) |

(52) U.S. Cl. ..... 264/40.1; 28/221; 28/255; 28/263; 28/265; 28/266; 28/267; 264/103; 264/210.3; 264/210.7; 264/210.8; 264/211.12; 264/211.14; 264/211.17

(58) Field of Classification Search ..... 264/40.1, 264/103, 210.3, 210.7, 210.8, 211.12, 211.14, 264/211.17; 425/66; 28/221, 255, 263, 28/265, 266, 267

See application file for complete search history.

(56) References Cited

U.S. PATENT DOCUMENTS

| | | | | |
|---|---|---|---|---|
| 4,059,873 | A * | 11/1977 | Nelson | 28/271 |
| 4,095,317 | A * | 6/1978 | Eskridge et al. | 28/221 |
| 4,251,481 | A | 2/1981 | Hamlyn | |
| 4,622,187 | A | 11/1986 | Palmer | |
| 5,879,800 | A | 3/1999 | Geirhos | |

FOREIGN PATENT DOCUMENTS

| | | | |
|---|---|---|---|
| DE | 42 02 896 | A1 | 8/1992 |
| DE | 42 24 454 | A1 | 2/1993 |
| DE | 198 26 654 | A1 | 12/1998 |
| DE | 101 00 762 | A1 | 8/2001 |
| EP | 0 164 624 | B1 | 12/1985 |
| EP | 0 801 159 | A2 | 10/1997 |
| GB | 1 352 624 | A | 5/1974 |
| GB | 1 538 405 | A | 1/1979 |

OTHER PUBLICATIONS

International Search Report for PCT/EP02/04870 completed Jul. 26, 2002.

* cited by examiner

*Primary Examiner*—Leo B. Tentoni
(74) *Attorney, Agent, or Firm*—Alston & Bird LLP

(57) ABSTRACT

A method and apparatus for producing a high-strength and low-shrinkage synthetic flat yarn. After melt spinning, the filaments are combined to a yarn and drawn. Subsequently, the yarn is compressed to form a plug under the influence of heat. This plug is transported over a certain distance, so that the yarn relaxes in a low-tension state and under the influence of the increased temperature. Finally the plug is disentangled under tension to form the flat yarn, which is wound into a package.

9 Claims, 3 Drawing Sheets

METHOD AND APPARATUS FOR PRODUCING A LOW-SHRINKING SMOOTH YARN

CROSS REFERENCE TO RELATED APPLICATION

The present application is a continuation of International Application No. PCT/EP02/04870, filed May 3, 2002, and which designates the U.S. The disclosure of said application is expressly incorporated herein by reference.

BACKGROUND OF THE INVENTION

The present invention relates to a method of producing a low-shrinkage synthetic flat yarn, as well as an apparatus for carrying out the method.

High-strength flat yarns, which are used, for example, for producing PVC-coated tarps, conveyor belts, or V-belts, are required to exhibit only little shrinkage by the action of heat, when being further processed.

Therefore, in the production of these flat yarns, one subjects the yarn after the melt spinning and drawing steps one more time to an increased temperature and reduced tension, so that the yarn is able to relax. Such a method is described in EP 0 164 624 B1.

It has been found that the parameters low yarn tension, temperature, and time are important for the shrinkage of the yarn during relaxation. The apparatus disclosed in EP 0 164 624 B1 does simply not permit adjusting the parameters yarn tension, time, and temperature, as desired. On the one hand, it is necessary to maintain a minimum yarn tension for a satisfactory yarn advance. On the other hand, a long dwelling time would require at high yarn speeds a great distance to cover, which may easily lead in addition to an unstable yarn advance under a very low yarn tension. A removal of the shrinkage in the yarn on the finished package may result in that after winding, such high forces are active in the yarn package that the package can no longer be removed from the mandrel.

It is therefore an object of the invention to extend the known method and the known apparatus, so that long dwelling times are obtained during a relaxation, while keeping the yarn tension as low as possible.

SUMMARY OF THE INVENTION

The invention distinguishes itself in that a relaxation treatment with long dwelling times is possible even at relatively high yarn speeds. In this process, an advancing multifilament yarn is drawn in a first step after having been spun from a melt. For the subsequent relaxation, the yarn is compressed by forming a plug in a relaxation device with a stuffer box chamber. To this end, the yarn is advanced, while being heated, into the stuffer box chamber, where it is compressed. As a result of continuously advancing yarn, the plug advances through the relaxation device under no tension.

Since the plug has a clearly larger diameter than the yarn, the speed of the plug is substantially lower than the supply speed of the yarn because of the continuity condition. With that, it is possible to obtain also with short guide lengths of the relaxation device, relatively long dwelling times at a high temperature and in a state free from tension. Upon leaving the relaxation device, the flat yarn is withdrawn from the plug by applying tension. Contrary to a crimping device, where the plug normally undergoes cooling to set the crimp, the yarn is withdrawn from the relaxation device in a heated state and thus further processed under such a high yarn tension that no crimp remains in the yarn, and that thus a typical flat yarn is produced.

As a particular example, the use of polyester permits producing a flat yarn from the plug under a relatively low withdrawal tension. Thus, all types of polyester are to be considered highly suitable.

To advance the yarn to form a plug while being heated, it is preferred to use for advancing the yarn a heated medium, which a feed nozzle delivers into the stuffer box chamber together with the yarn. The medium may be formed by hot air or a hot vapor.

A variant of the method according to the invention provides for a final drawing after relaxation. This permits removing any latent residual crimp, which may possibly remain in the yarn.

In a particularly advantageous variant of the method, the step of disentangling the plug is supplemented and secured by additional method steps. Fluctuations of yarn or method parameters may result in the feed and withdrawal of differently large yarn mass flows, which may possibly cause the length of the plug to increase or decrease continuously. For this reason, this variant of the method provides for sensing the position of the plug end, and taking corrective action with respect to the temperature of the medium.

In a further advantageous variant of the method, the rotational speed of the godet that withdraws the yarn is influenced as an alternative or as an addition. This intervention permits achieving an immediate effect on the plug length.

Characteristic of the invention is that the yarn speed in the yarn path downstream of the relaxation device is lower than the yarn speed in the yarn path upstream of the relaxation device. The winding speed, however, is again slightly higher than the yarn speed downstream of the relaxation device. For the invention, this results in that the takeup device is operated at a winding speed, which amounts to more than about 85% of the circumferential speed of the last godet upstream of the relaxation device.

Naturally, is also possible to use the method of the present invention for the production of monofilaments, i.e., for yarns, which consist of only one thick filament.

An apparatus for carrying out the method of the invention comprises a spinning device in which the filaments are melt spun, a draw zone in which the yarn is drawn to a high-strength yarn, a stuffer box chamber as a relaxation device, and a takeup device. The stuffer box chamber is designed such that during the compression of the yarn, the deposited filaments form as few loops and curls as possible. Important in this process is the possibility that the tempered yarn advances as a plug in the stuffer box chamber under little tension for a longest possible dwelling time, so that after disentangling the plug, a flat yarn with a very low shrinkage is produced.

In a further development of the apparatus according to the invention, a final draw zone may be provided downstream of the relaxation device. This final draw zone increases the yarn tension slightly for purposes of flattening the yarn again downstream of the relaxation device. In the simplest case, a pair of godets, which cooperate with the takeup device, forms the final draw zone. However, it is also possible to use two pairs of godets, with the second godet pair operating at a slightly higher speed, so as to build up a yarn tension. In the place of the paired godets, it is also possible to use godets with guide rolls.

To obtain a uniform advance of the yarn while heating it simultaneously, the relaxation device preferably includes a feed nozzle, which connects to a source of medium, and receives a hot medium. This permits heating and advancing the yarn, for example, by hot air or a hot vapor.

BRIEF DESCRIPTION OF THE DRAWINGS

In the following, the method of the invention and an embodiment of the apparatus according to the invention are described in greater detail with reference to the attached drawings, in which.

DETAILED DESCRIPTION OF THE PREFERRED EMBODIMENTS

Figure 1:
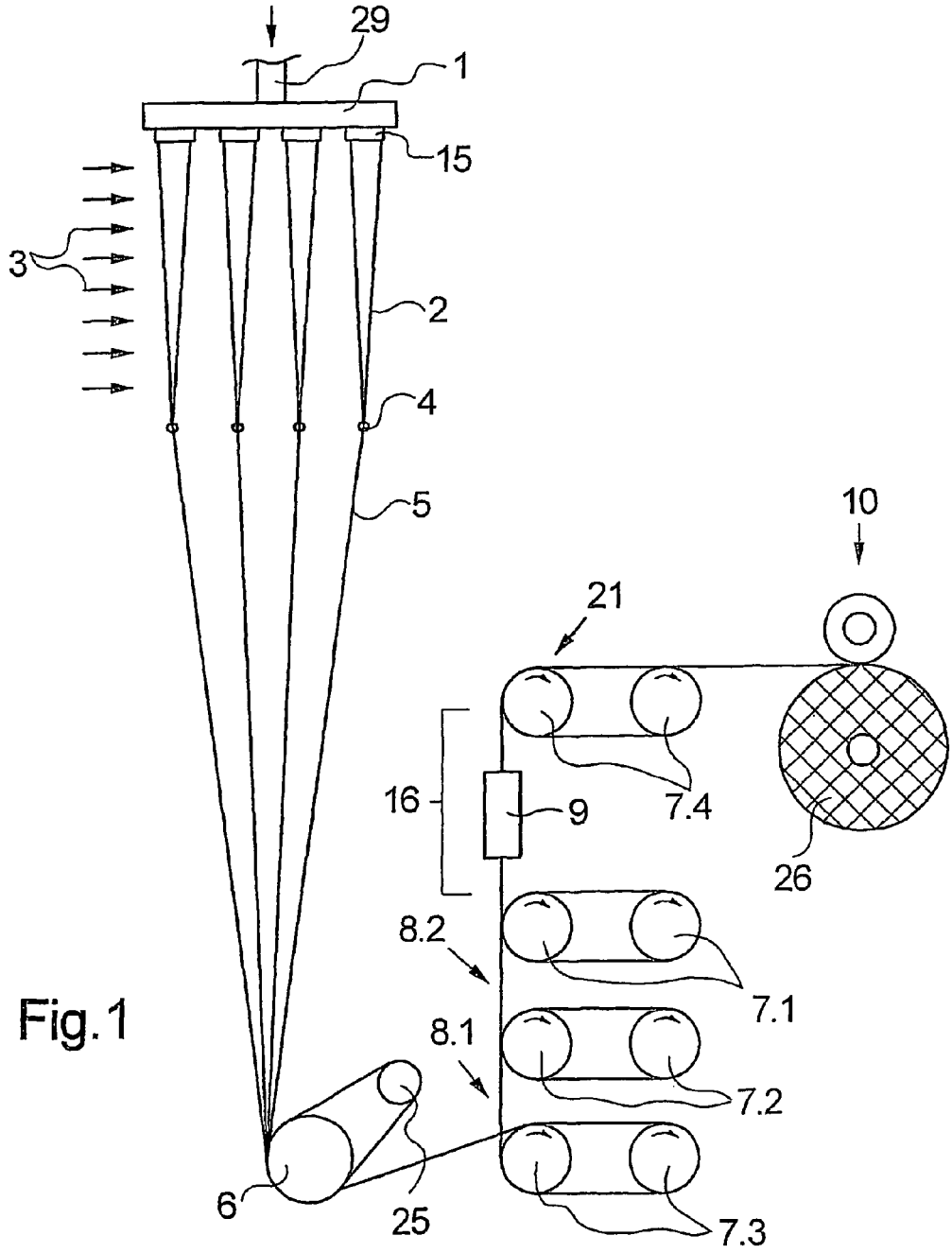
FIG. 1 is a schematic view of a first embodiment of the apparatus according to the invention, wherein the method of the invention is used.

Referring more particularly to the drawings, an apparatus which embodies the invention is illustrated in FIG. 1, and which comprises a melt spinning device, which is formed by a spin head 1 and a plurality of spinnerets 15. The spin head 1 connects via a melt supply line 29 to a source of melt not shown, for example, an extruder. The underside of the spin head 1 mounts a plurality of spinnerets 15, which each include a plurality of spin nozzle bores for extruding therethrough a group of filaments 2. The embodiment shows, for example, four spinnerets 15.

After its extrusion, each group of filaments 2 is cooled by a cooling air 3, wetted with a lubricant in a lubrication device 4, and combined to a yarn 5. Although this description applies to multifilament yarns, it is basically also usable for monofilament yarns.

After the yarn 5 has been formed, it is first withdrawn by a godet 6 that cooperates with a guide roll 25. It is common practice to produce in such spin lines a plurality of yarns in a parallel process, and to treat them in parallel on the same godets. In the following, the devices of the apparatus and the method are described for one yarn for reasons of simplification.

Downstream of the godet 6, the yarn 5 advances to a draw zone, which is formed by a plurality of paired godets 7.1, 7.2, and 7.3. In so doing, the yarn is first drawn between two heated pairs of godets 7.1 and 7.2 in a first draw zone 8.1, and subsequently between two heated pairs of godets 7.2 and 7.3 in a second draw zone 8.2. After this treatment, the yarn 5 has attained a high strength, but tends to shrink under the influence of the temperature. This is especially undesired in the described applications, wherein the yarns are coated with heated coating substances in a later further processing. For this reason, the yarn 5 advances through a downstream relaxation zone 16 with a relaxation device 9. By the temperature and in a state free from tension, the yarn 5 is given in the relaxation device 9 an opportunity to relax, i.e., to remove its tendency to shrink. In so doing, the yarn shortens by about 13% depending on the polymer and process parameters.

To this end, the yarn 5 is compressed to a plug within the relaxation device 9, which is described in greater detail with reference to FIG. 2. A parallel treatment of a plurality of yarns makes it possible to provide for each yarn a separate relaxation device, or to treat a plurality of yarns in a common relaxation device.

After the relaxation, the plug is withdrawn under tension as a flat yarn 22. To this end, a final draw zone 21 is provided, which is formed in the present embodiment by a further pair of godets 7.4. Subsequently, the flat yarn 22 is wound by means of a takeup device 10 to a package 26.

Since downstream of the relaxation device 9, in particular between the pair of godets 7.4 and takeup device 10, a higher yarn tension level prevails, any crimp that may possibly have remained in the yarn, is removed. In this connection, the operation is named final drawing.

To disentangle the plug, the final draw zone 21 could also be formed by a godet with a guide roll. For a final drawing in this instance, the godet cooperates with the takeup unit.

Figure 2:
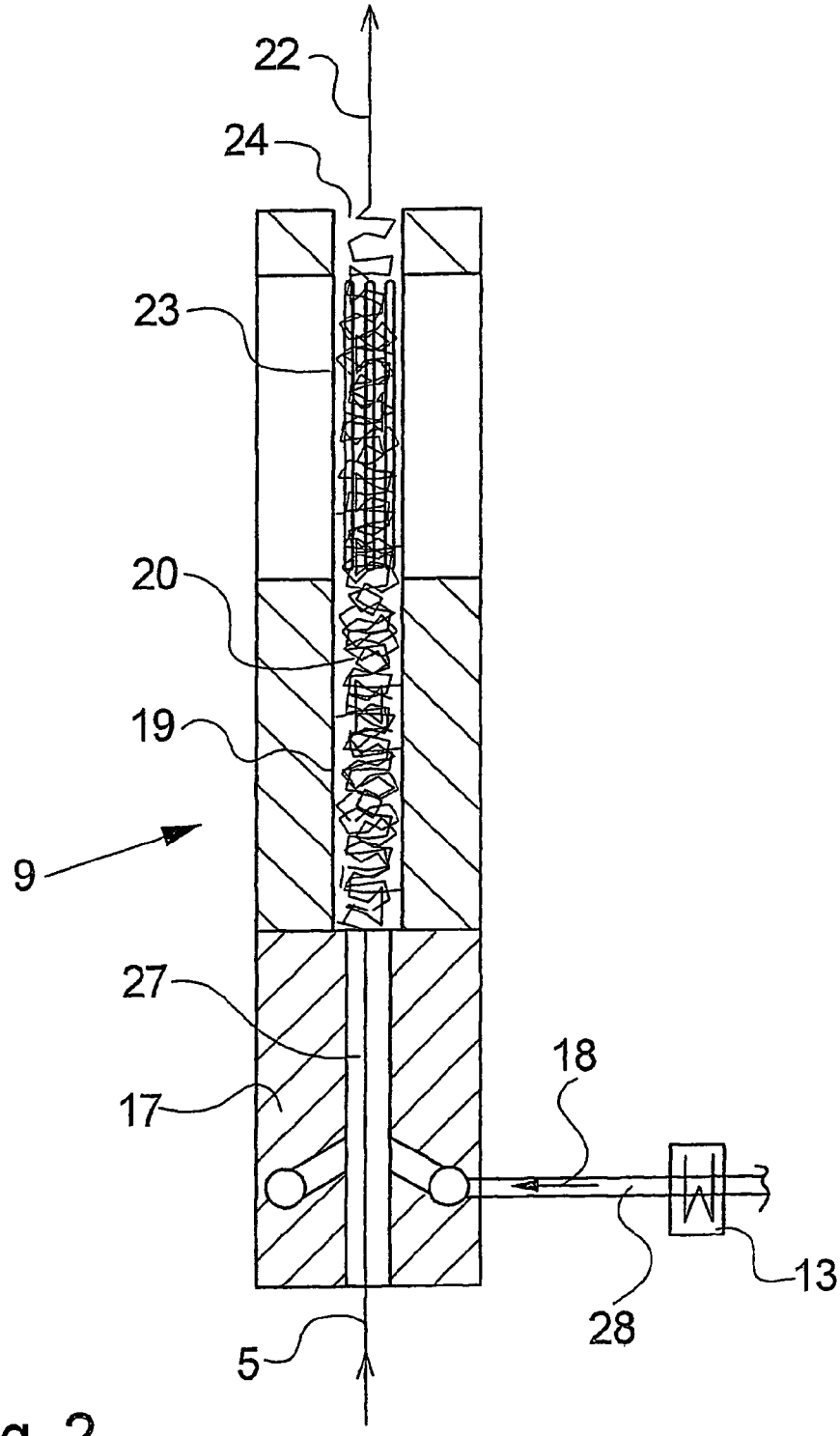
FIG. 2 is a schematic sectional view of the relaxation device of the embodiment of FIG. 1.

FIG. 2 is a sectional view of a possible embodiment of the relaxation device 9. With the aid of the relaxation device, it is possible to carry out the method of the present invention. The relaxation device 9 comprises a feed nozzle 17, which receives a heated medium 18 via a line 28. The medium 18, which has previously been heated by a heater 13, enters a yarn channel 27 for advancing the yarn 5. The yarn channel 27 terminates in a stuffer box chamber 19 of the relaxation device 9. Inside the stuffer box chamber 19, the yarn 5 is advanced to form a plug 20. In this process, the yarn forms loops, which lead to an accumulation and as a result to a compression, so that the yarn 5 forms the plug 20, which slowly advances through the stuffer box chamber 19 of the relaxation device 9. In this process, a hot fluid, such as hot air or vapor is used as conveying medium 18 for providing the yarn with a temperature level that is necessary for the relaxation. A guide section 23 of the stuffer box chamber 19 includes a plurality of slots, through which the medium is again discharged. Subsequently, the plug 20 leaves the relaxation device 9 through an outlet opening 24, and is disentangled to form a flat yarn 22.

If one assumes a yarn denier of 1000 dtex as well as a supply speed of 5000 m/min., these will correspond to an entering mass flow of 500 g/min. With a volume of the stuffing region of about 31 $cm^3$, at a diameter of 2 cm, and a length of 10 cm, this will result with a plug density of 20% and polyester as a polymer, in a dwelling time of the yarn in the relaxation device 9 of approximately 1 second.

After leaving the relaxation device, the flat yarn 22 is withdrawn from the plug 20, since it is subsequently advanced again at a high speed by the pair of godets 7.4 shown in FIG. 1. Because of the high acceleration that occurs in this process, mass forces arise, which produce tensions in the yarn, and which adequately stabilize the yarn. In this process, it is necessary to adjust the speed, at which the yarn is withdrawn, in a way that the yarn mass supplied per unit time to the relaxation device is identical with the yarn mass that is withdrawn therefrom.

If the withdrawn yarn mass were greater, the plug would be completely withdrawn from the relaxation device. If the withdrawn yarn mass were smaller, the plug development at the inlet of the stuffer box chamber 19 would be greater than the plug withdrawal at the outlet 24, so that the plug would grow out of the relaxation device 9.

Figure 3:
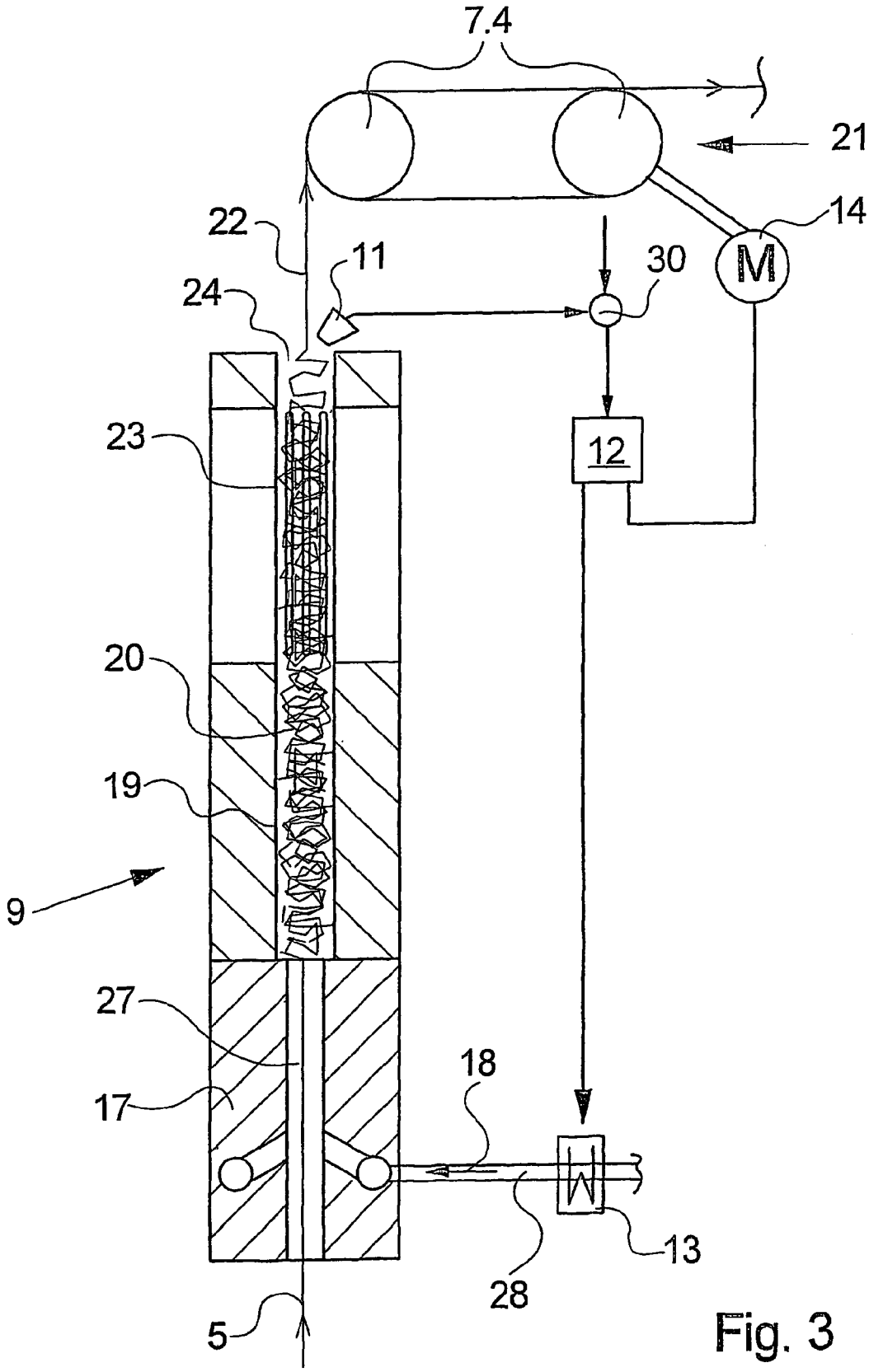
FIG. 3 is a schematic view of a further embodiment of a relaxation device.

FIG. 3 illustrates a further embodiment of the relaxation device 9, which would be usable in the apparatus of FIG. 1, and which comprises an adjustment of the plug formation. The relaxation device 9 is constructed substantially identical with the embodiment of FIG. 2, so that in the following only differences are described.

At the outlet opening 24 of the relaxation device 9, a sensor 11 is provided, which senses a growth or a reduction of the plug. The signaled value of the sensor 11 is compared in a comparator 30 with a desired value, and supplied to a controller 12, when a deviation is found. The controller 12 connects to a heater 13, which heats the medium 18 that is supplied to the feed nozzle 17. Via the controller 12, it is thus possible to exert a corrective influence on the heating of the medium 18. The controller 12 also connects to a godet drive 14, which operates the pair of godets 7.4 of the final draw zone 21. It is thus possible to make a corrective change of the rotational speed of drive 14, which operates the pair of godets 7.4.

An increase in the temperature of the medium 18 produces a greater relaxation of the yarn, so as to realize a shortening and thus a larger mass per length. At a constant circumferential speed of the pair of godets 7.4, this leads to a greater withdrawal of mass and thus to a diminution of the plug.

An increase in the rotational speed of the godet pair 7.4 directly causes a greater mass transportation and thus likewise a diminution of the plug 22. In this connection, it should be noted that the rotational speed of the godet pair 7.4 immediately affects the plug length, whereas the temperature has an effect on the plug length only with a time delay, which corresponds approximately to the dwelling time of the yarn in the relaxation device.

However, it is also possible to use the relaxation device 9 shown in FIG. 3 only in connection with a temperature control of the conveying medium or only with a speed control of the pair of godets.

The relaxation devices shown in FIGS. 2 and 3 are exemplary. Thus, it would be possible to use in the apparatus of FIG. 1 any relaxation device, in which a conveying medium advances the yarn to form a plug and heats it inside a stuffer box chamber. The compression of the yarn makes is possible to achieve adequate dwelling times for relaxing the yarn even at high yarn speeds. It is preferred to compress the yarn with a low plug density for purposes of attaining a largely complete removal of the loops and curls already during the disentanglement of the plug, so that thereafter the yarn no longer contains a crimp.

The invention claimed is:

1. A method of producing a high-strength, low-shrinkage synthetic flat yarn, comprising the steps of melt spinning a plurality of advancing filaments from a molten polymer;

cooling and combining the filaments to form an advancing multifilament yarn;

drawing the advancing yarn;

compressing the advancing and drawn yarn while heating the yarn to form an advancing plug at an increased temperature;

disentangling the plug under a tension so as to withdraw the yarn from the plug in a heated condition and with the tension being sufficient to remove any crimp and form an advancing flat yarn; and winding the flat yarn into a package.

2. The method of claim 1, wherein the molten polymer for melt spinning the filaments is extruded from a polyester.

3. The method of claim 1, wherein the compressing step occurs with the aid of a medium, which advances the yarn for forming the plug.

4. The method of claim 3, wherein the medium consists of hot air or hot vapor.

5. The method of claim 1, wherein the flat yarn is additionally drawn after disentangling the plug and before it is wound into a package.

6. The method of claim 3, wherein while disentangling the plug, the position of the plug end is sensed, and that as a function of the position of the plug end, the temperature of the medium is controlled.

7. The method of claim 1, wherein while disentangling the plug, the position of the plug end is sensed, and that as a function of the position of the plug end, the withdrawal speed of the flat yarn from the plug is controlled.

8. The method of claim 1, wherein before being compressed, the yarn is guided by a godet, and that the ratio of the takeup speed for winding the flat yarn to the circumferential speed of the godet is greater than about 0.85 to 1.

9. A method of producing a high-strength, low-shrinkage synthetic flat yarn, comprising the steps of melt spinning at least one advancing filament from a molten polymer;

cooling the one filament to form an advancing yarn;

drawing the advancing yarn;

compressing the advancing and drawn yarn while heating the yarn to form an advancing plug at an increased temperature;

disentangling the plug under a tension so as to withdraw the yarn from the plug in a heated condition and with the tension being sufficient to remove any crimp and form an advancing flat yarn; and winding the flat yarn into a package.

* * * * *